United States Patent [19]

De Luca

[11] Patent Number: 4,519,663

[45] Date of Patent: May 28, 1985

[54] WIRE PLUG ASSEMBLY

[75] Inventor: Paul V. De Luca, Plandome Manor, N.Y.

[73] Assignee: Porta Systems Corp., Syosset, N.Y.

[21] Appl. No.: 387,935

[22] Filed: Jun. 14, 1982

[51] Int. Cl.[3] ..... H01R 9/07

[52] U.S. Cl. ..... 339/99 R; 339/97 R

[58] Field of Search ..... 339/95 R, 99 R, 98 E, 339/97 R, 17 LC, 19, 17 C, 91 R

[56] References Cited

U.S. PATENT DOCUMENTS

| | | | |
|---|---|---|---|
| 4,066,316 | 1/1978 | Rollings | 339/97 R |
| 4,099,819 | 7/1978 | Keglewitsch | 339/99 R X |
| 4,195,898 | 4/1980 | Chow et al. | 339/99 R |
| 4,352,531 | 10/1982 | Gutter | 339/19 X |
| 4,405,193 | 9/1983 | Weidler | 339/99 R |

*Primary Examiner*—William R. Briggs
*Attorney, Agent, or Firm*—Charles E. Temko

[57] ABSTRACT

A system for providing cross connections for telephone subscriber lines to associate them with office line equipment within a telephone office. The system includes a plurality of jack boards mounted on telephone main frames, each defining a series of interconnection locations including a pair of projecting contacts and a socket adjacent to the contacts. Cooperating with each location is a plug assembly with corresponding projection and female contacts, the last mentioned contacts including means for displacing insulation on engaged conductors upon the closing together of two component parts comprising a housing. The use of usual wire wrapping techniques is completely eliminated, and the use of less skilled personnel in making the cross connections is possible.

3 Claims, 9 Drawing Figures

WIRE PLUG ASSEMBLY

BACKGROUND OF THE INVENTION

This invention relates generally to the field of telephony, and more particularly to an improved system for making cross connections from frame to frame or block to block within a telephone office.

When individual subscriber lines enter a telephone office, they are normally conducted to protective equipment located on a main frame. Office switching and other equipment is similarly connected to other main frames. It is known in the art to provide communication between the office equipment and subscriber lines by cross connection conductors in the form of wire jumpers, the ends of which are wire wrapped about contact pins. The wire wrapping operation requires relatively skilled labor and the use of a wire wrapping tool to accomplish this end. Further, it is usually not possible to measure the length of the jumper required prior to installation, or to prepare jumpers of fixed length prior to installation.

SUMMARY OF THE INVENTION

Briefly stated, the invention contemplates the provision of an improved cross connecting system for the above described purpose which will eliminate the necessity of using wire wrapped interconnections and permit the use of service personnel of lesser skills to perform such cross connections. To this end, there is provided a plurality of jack boards of specialized configuration which are mounted upon main frames. Cooperating with the jack boards are a plurality of wire plug assemblies, each including a two part separable housing and internal contacts having wire insulation displacement means which permits rapid assembly by a semi-skilled worker without the use of tools. The jumpers can be assembled in advance, using varying lengths of conductors, or assembled on the site for individual installation by merely cutting the required length of conductor and attaching a plug assembly to each end prior to engagement with the respective jack boards. Such engagement includes the insertion of contact pins projecting from the block to engage contacts within the housing of the plug assembly to complete the cross connection. A resilient projection on the plug assembly penetrates a corresponding opening in the jack board to effect a detenting action.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
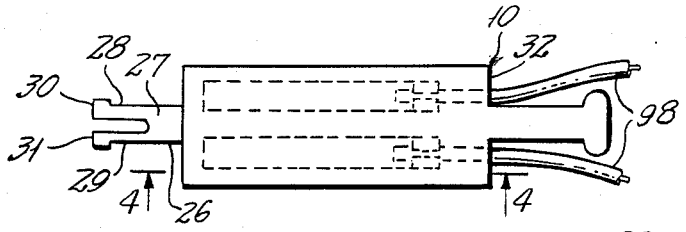
FIG. 1 is a top plan view of an assembled plug element forming a component of a disclosed embodiment of the invention.
Figure 2:
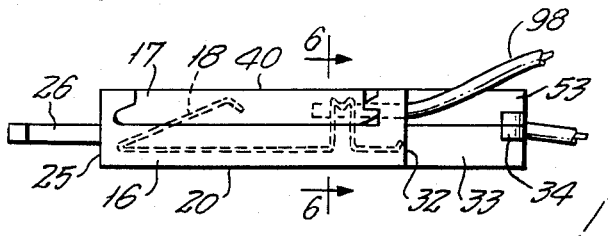
FIG. 2 is a side elevational view thereof.
Figure 3:
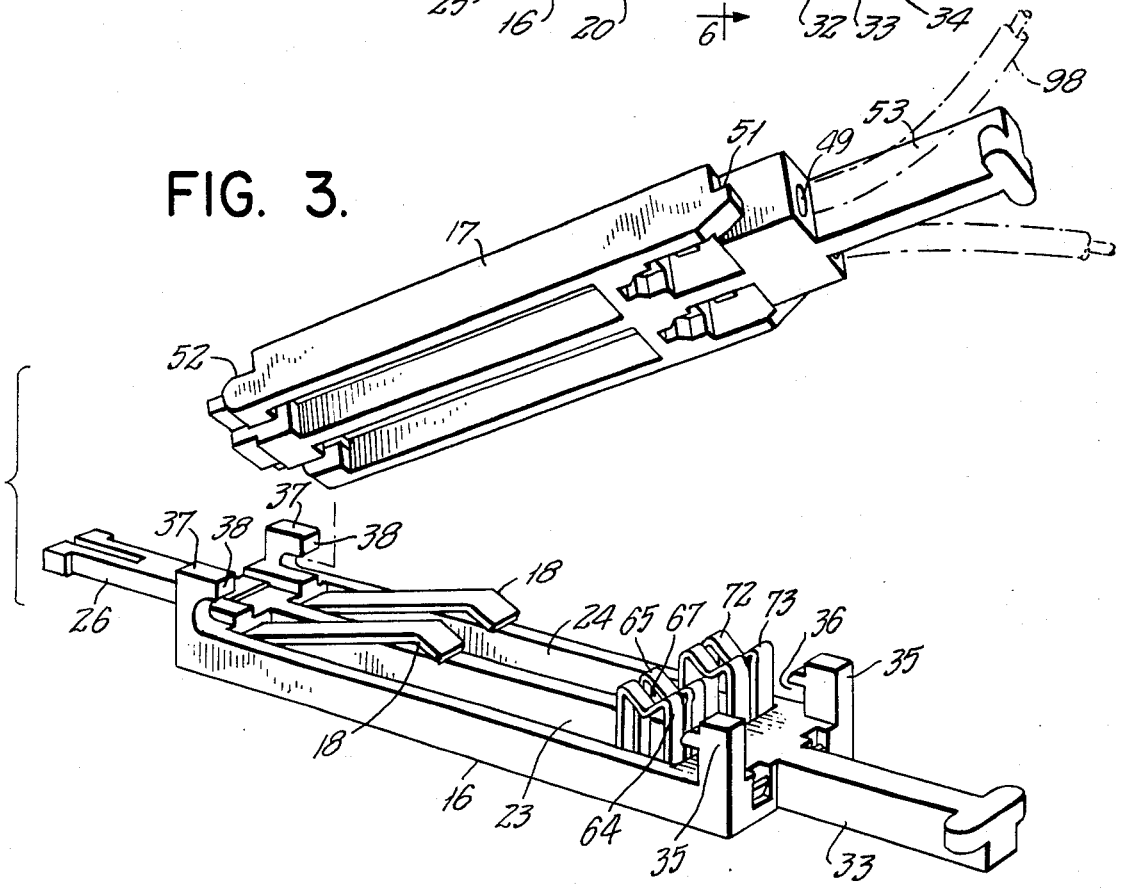
FIG. 3 is an exploded view in perspective thereof.

In accordance with the invention, the disclosed embodiment includes a plurality of wire plug elements, one of which is indicated by reference character 10 and a corresponding jack board element 11.

The plug element 10 includes first and second selectively interconnectable housing members 16 and 17, respectively, and a pair of contact members 18 disposed therein.

The housing member 16 includes a side wall 20 bounded by an outer surface 21 and an inner surface 22. Extending longitudinally from a first end surface 25 is an elongated bifurcated projection 26 including a main body portion 27 and first and second leg portions 28 and 29, respectively. These terminate in enlarged terminals 30 and 31.

Extending from a second end surface 32 is a manually engageable handle 33 terminating in a small enlargement 34. First and second engagement members 35 define corresponding recesses 23 and 24. On an opposite end are first and second latch members 37 including axially oriented projections 38.

Formed in the body of member 16 are a pair of retaining channels 39 in which the contact members 18 are disposed.

The second housing member 17 is of corresponding configuration, and includes a side wall 40 bounded by an outer surface 41 and an inner surface 42. It defines a pair of relatively longer channels 43 terminating in end openings 45 and a pair of shorter channels 47 communicating with end openings 49. Longitudinal projections 51 correspond to recesses 36, and latch members 52 interlock with latch members 37 during assembly of the members 16 and 17. A handle member 53 mates with the member 33.

The contact members 18 are preferably formed from unitary metallic stampings, and include a first terminal 61 which are inserted in retaining channels 39 in the member 16, and a rectilinear member 62 leading to a wire terminal engaging member 63. The member 63 includes first and second laterally extending portions 64 and 65 joined by a pair of cross pieces 66 defining an opening 67 corresponding to the diameter of an insulated conductor used with the plug element. The opening 67 leads to a pair of insulation displacement slots 68 including an upper guide portion 69 and a rectilinear edge portion 70 which corresponds generally to the diameter of a bared conductor. Because there are two wire displacement means, one located in each laterally extending portion 64 and 65, a strain relief function is also performed at points 72 and 73.

Communicating with the member 63 is an elongated portion 65 joining a resilient bent portion 66, a pin contact portion 67, a fold edge 68 and a terminal portion 69.

The jack board element 11 is preferably formed as a synthetic resinous molding using techniques known in the art, and is of a configuration suitable for mounting on a known main frame (not shown). It is bounded by an inner surface 85, an outer surface 86, and side edges one of which is indicated by reference character 87. A plurality of aligned engagement areas 92 are provided, each including first and second pins 93 and 94 which penetrate the plug element 10 to make contact with the contact members 18. At the same time, the projection 26 penetrates an adjacent rectangular opening 97 to effect a detent engagement.

Figure 4:
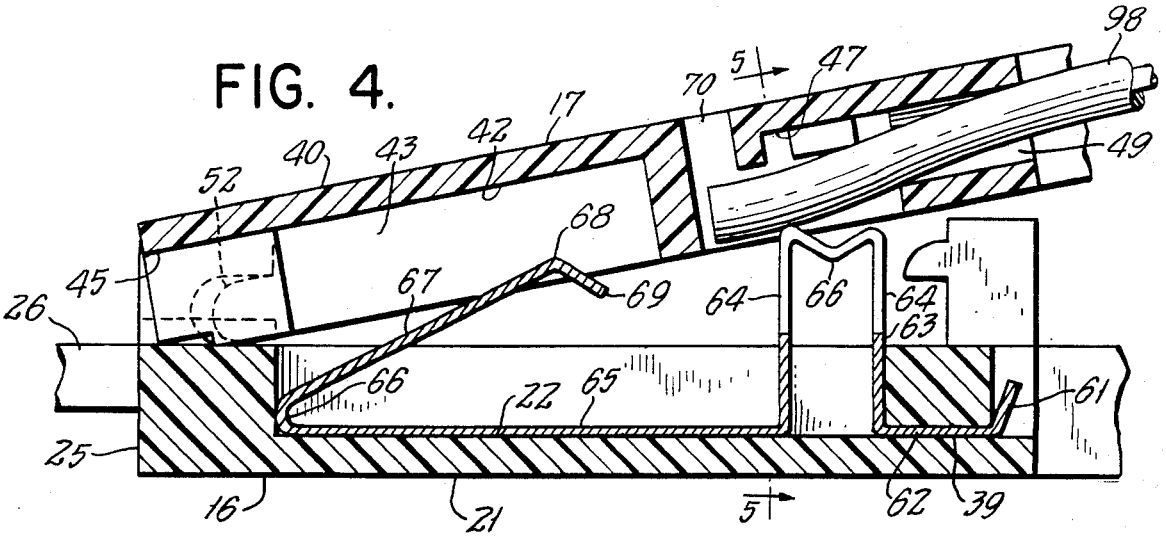
FIG. 4 is a fragmentary enlarged sectional view as seen from the plane 4—4 in FIG. 1.
Figure 5:
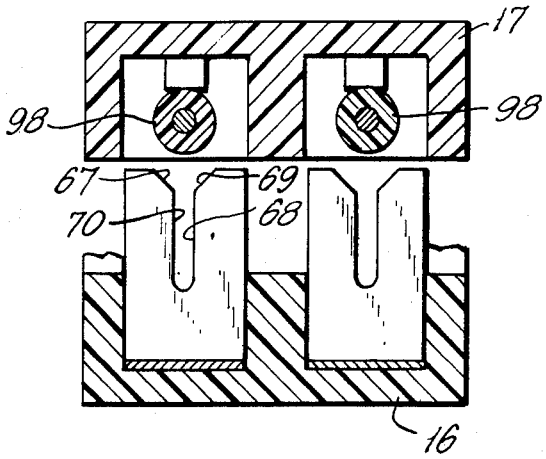
FIG. 5 is a longitudinal sectional view as seen from the plane 5—5 in FIG 4.
Figure 6:
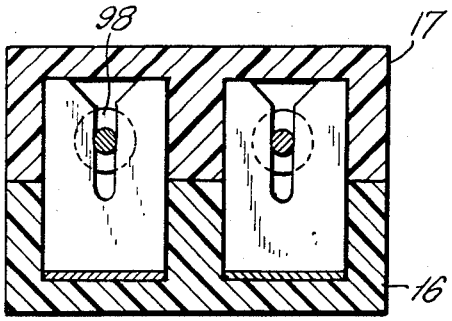
FIG. 6 is a transverse sectional view as seen from the plane 6—6 in FIG. 1.
Figure 7:
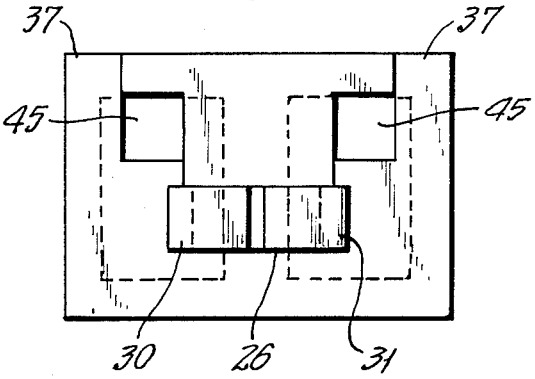
FIG. 7 is an end elevational view as seen from the right hand portion of FIG. 1 with wiring removed for purposes of clarity.
Figure 8:
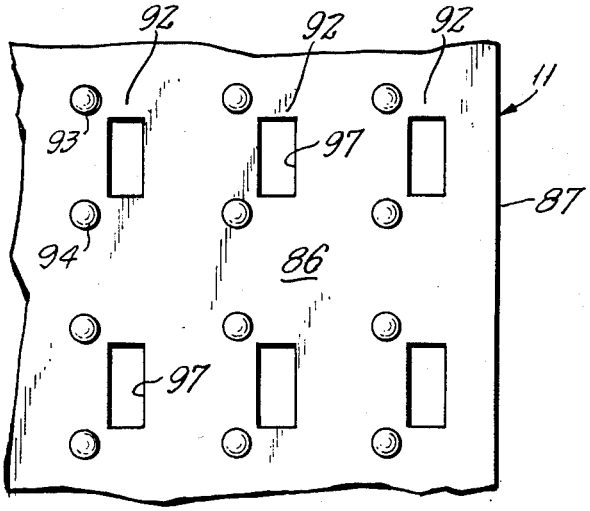
FIG. 8 is a fragmentary enlarged view of a jack board forming a part of the embodiment.
Figure 9:
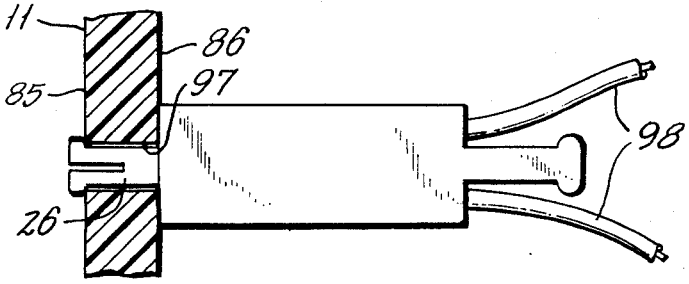
FIG. 9 is a transverse sectional view showing a single plug interconnected to an area on a jack board.

Assembly of the device requires only the insertion of the ends of premeasured conductors into the shorter channels 47 and 48 to position them above the respective member 63 as viewed through openings 70. The housing members 16 and 17 are then partially interconnected, as shown in FIG. 4, and move to fully closed position to result in forcing the ends of the conductors, generally indicated by reference character 98 into the respective wire terminal engaging member 63 to complete electrical communication. A corresponding operation is perfomed at the opposite end of the conductors 98, and the fully assembled plug elements are then interconnected at the proper area 92 on the respective jack board. Since many distances between corresponding areas 92 will be of standardized length, it will be possible, in many instances to completely assemble a complete jumper including a pair of plug elements at the ends thereof, in advance, it being necessary only for the worker to select a jumper of proper length prior to interconnection.

It is to be understood that it is not considered that the invention is limited to the precise details of structure shown and set forth in this specification, for obvious modifications will occur to those skilled in the art to which the invention pertains.

What is claimed is:

1. An improved wire plug assembly for use in interconnecting a telephone subscriber pair between corresponding connecter blocks comprising: first and second elongate interconnectable housing members, means at first and second ends of said housing members for the interconnection of said housing members to define plural communicating recesses therein; a pair of resilient contact members disposed in two parallel recesses of said plural recesses, said housing member defining end openings for the insertion of electrically conductive pins therethrough to engage said resilient contact members substantially at one end thereof; said contact members having wire insulation displacement means substantially at a second end thereof, at least one of said housing members defining end openings therein for the insertion of an insulated conductor to be positioned opposite the insulation displacement means of one of said contact members, said insulation displacement means engaging an end of said conductor upon the closing of said pair of housing members to assemble said plug assembly; said housing element having a resilient detent projection on an end thereof adjacent said openings for said conductive pins for the engagement of a corresponding opening in a jack board, and a handle member on an opposite end of said housing element to permit disengagement of said plug assembly from said jack board.

2. An improved wire plug assembly in accordance with claim 1, one of said housing members having openings therein permitting the viewing of the end of inserted conductors to assist in the positioning thereof.

3. An improved wire plug assembly in accordance with claim 1, in combination with a corresponding jack board defining at least one area having projecting pins and a through recess adjacent said pins, said pins penetrating said opening in said housing, said recess accomodating said resilient detent projection.

* * * * *